US009163464B2

(12) United States Patent
Wright

(10) Patent No.: US 9,163,464 B2
(45) Date of Patent: Oct. 20, 2015

(54) SYSTEMS FOR STABILIZING OILFIELD EQUIPMENT

(71) Applicant: David C. Wright, Spring, TX (US)

(72) Inventor: David C. Wright, Spring, TX (US)

( * ) Notice: Subject to any disclaimer, the term of this patent is extended or adjusted under 35 U.S.C. 154(b) by 0 days.

(21) Appl. No.: 14/262,365

(22) Filed: Apr. 25, 2014

(65) Prior Publication Data

US 2014/0231091 A1 Aug. 21, 2014

Related U.S. Application Data

(63) Continuation of application No. 13/135,017, filed on Jun. 23, 2011, now Pat. No. 8,746,351.

(51) Int. Cl.
*E21B 19/00* (2006.01)

(52) U.S. Cl.
CPC ..... *E21B 19/006* (2013.01)

(58) Field of Classification Search
CPC ..... E21B 19/006; E21B 7/128; E21B 33/038; E21B 17/07; E21B 23/08; E21B 43/01; E21B 7/12
USPC ..... 405/224.1–224.2; 267/125; 166/350, 166/367, 355
See application file for complete search history.

(56) References Cited

U.S. PATENT DOCUMENTS

| | | | | | |
|---|---|---|---|---|---|
| 2,402,157 | A | * | 6/1946 | Griswold | 244/111 |
| 3,158,206 | A | | 11/1964 | Kammerer | |
| 3,905,580 | A | | 9/1975 | Hooper | |
| 4,004,532 | A | * | 1/1977 | Reynolds | 114/256 |
| 4,055,338 | A | * | 10/1977 | Dyer | 267/125 |
| 4,098,333 | A | | 7/1978 | Wells et al. | |
| 4,379,657 | A | | 4/1983 | Widiner et al. | |
| 4,382,361 | A | | 5/1983 | Blanchet | |
| 4,506,591 | A | | 3/1985 | Blanchet | |
| 4,615,542 | A | * | 10/1986 | Ideno et al. | 285/11 |
| 4,733,991 | A | | 3/1988 | Myers | |
| 4,799,827 | A | * | 1/1989 | Jaqua | 405/224.4 |
| 4,858,694 | A | | 8/1989 | Johnson et al. | |
| 5,069,058 | A | | 12/1991 | Hyatt | |
| 5,069,488 | A | * | 12/1991 | Freyer et al. | 285/302 |
| 5,657,823 | A | | 8/1997 | Kogure et al. | |
| 5,894,895 | A | | 4/1999 | Welsh | |
| 6,343,893 | B1 | | 2/2002 | Gleditsch | |
| 7,231,981 | B2 | * | 6/2007 | Moe et al. | 166/355 |
| 7,731,157 | B2 | | 6/2010 | Davidson | |
| 7,823,646 | B2 | * | 11/2010 | Ellis et al. | 166/355 |
| 8,356,672 | B2 | * | 1/2013 | Fraser et al. | 166/345 |
| 8,727,014 | B2 | * | 5/2014 | Edwards | 166/350 |
| 2002/0197115 | A1 | | 12/2002 | Borseth | |
| 2003/0111799 | A1 | * | 6/2003 | Gilmore | 277/510 |
| 2004/0262012 | A1 | * | 12/2004 | McGuire et al. | 166/370 |
| 2005/0123359 | A1 | * | 6/2005 | McCarty et al. | 405/224.4 |
| 2008/0271896 | A1 | * | 11/2008 | Inderberg et al. | 166/355 |
| 2008/0304916 | A1 | | 12/2008 | Crotwell et al. | |

* cited by examiner

*Primary Examiner* — James G Sayre

(57) ABSTRACT

An apparatus for stabilizing a conduit, such as a riser, against motion. The apparatus comprises an outer wall portion, an inner tubular member having a longitudinal channel extending therethrough, a first tubular member at least partially located between the outer wall portion and the inner tubular member, and a second tubular member at least partially located between the outer wall portion and the inner tubular member. The outer wall portion at least partially surrounds the inner tubular member and the first and second tubular members are movable about the inner tubular member and are movable relative to each other. The first and second tubular members are adapted for securing to the conduit, such as a riser.

19 Claims, 6 Drawing Sheets

SYSTEMS FOR STABILIZING OILFIELD EQUIPMENT

CROSS-REFERENCE TO RELATED APPLICATIONS

The present application is a non-provisional application claiming priority to the co-pending U.S. non-provisional patent application having the Ser. No. 13/135,017, entitled "Systems and Methods for Stabilizing Oilfield Equipment," filed on Jun. 23, 2011, the entirety of which is incorporated by reference herein.

FIELD

Embodiments usable within the scope of the present disclosure relate, generally, to systems, methods, and apparatus usable to stabilize oilfield risers and/or other conduits and objects against motion. More specifically, embodiments usable within the scope of the present disclosure relate to systems, methods, and apparatus used to stabilize, limit, and/or compensate for the motion of oilfield conduits, such as that created by waves and/or currents, through use of cylinder devices engageable with or along the conduit.

BRIEF DESCRIPTION OF THE DRAWINGS

In the detailed description of various embodiments usable within the scope of the present disclosure, presented below, reference is made to the accompanying drawings, in which.

Figure 1:
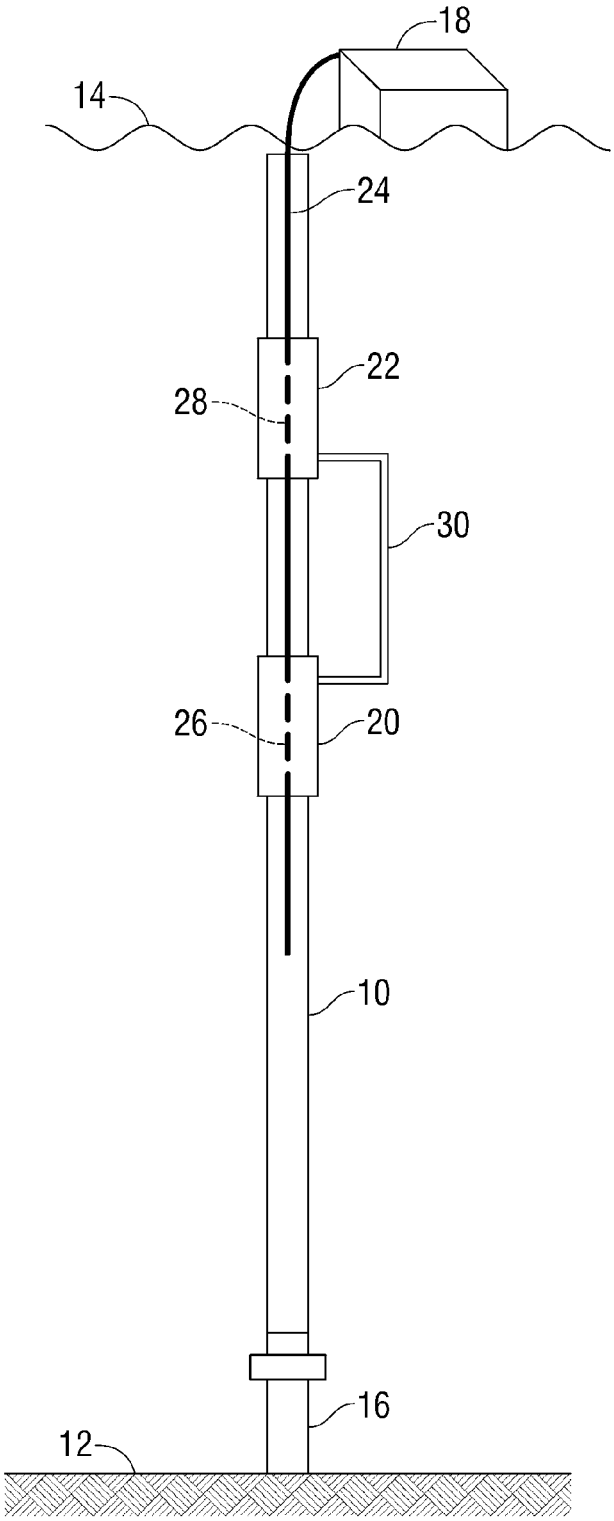
FIG. 1 depicts a diagrammatic view of an embodiment of a system usable within the scope of the present disclosure.

One or more embodiments are described below with reference to the listed Figures.

SUMMARY

The present disclosure is directed to an apparatus for stabilizing a conduit against motion. The apparatus can comprise a first cylinder assembly comprising a first outer wall and a first movable member slidably positioned within the first outer wall and a second cylinder apparatus comprising a second outer wall and a second movable member slidably positioned within the second outer wall. In an embodiment of the apparatus an end of the first movable member can be adapted for connection with a portion of the conduit and wherein an end of the second movable member can be adapted for connection with another portion of the conduit. The apparatus can also comprise a central tubular member having an axial bore extending therethrough, wherein the first and second movable members can be concentrically positioned about the central tubular member and the first and second movable members can be slidable about the central tubular member. The first outer wall can be spaced from the central tubular member to form a first annular space therebetween and the second outer wall can be spaced from the central tubular member to form a second annular space therebetween. The apparatus can further comprise a first fluid port for communicating a fluid into and out of the first annular space, the second annular space, or combinations thereof, wherein the axial bore of the central tubular member can be isolated from the first annular space and the second annular space.

The present disclosure is further directed to an apparatus for stabilizing a conduit against motion. An embodiment of the apparatus can comprise an outer wall portion, an inner tubular member having a longitudinal channel extending therethrough, wherein the outer wall portion can at least partially surround the inner tubular member, a first tubular member at least partially located between the outer wall portion and the inner tubular member, and a second tubular member at least partially located between the outer wall portion and the inner tubular member. In an embodiment of the apparatus, the first tubular member can be movable about the inner tubular member and the second tubular member can be movable about the inner tubular member. Furthermore, the first and second tubular members can be adapted for securing to the conduit and can be movable relative to each other.

The present disclosure is also directed to an apparatus for stabilizing a conduit against motion. The apparatus comprises a housing assembly, an internal tubular member having a longitudinal channel extending therethrough, wherein the internal tubular member can be at least partially positioned within the housing assembly to form an annular space therebetween. The housing assembly can include at least one fluid port for communicating a fluid into and out of the annular space. The apparatus can further comprise a first movable tubular member positioned concentrically about the internal tubular member, wherein the first movable tubular member can be slidable about the internal tubular member. The housing assembly can further include a second movable tubular member positioned concentrically about the internal tubular member, wherein the second movable tubular member can be slidable about the internal tubular member. In an embodiment of the apparatus, the first movable tubular member and the second movable tubular member can be movable relative to each other and can be adapted for securing to the conduit. In yet another embodiment of the apparatus, the longitudinal channel of the inner tubular member can be fluidly isolated from the annular space between the housing and the internal tubular member.

The foregoing is intended to give a general idea of the invention, and is not intended to fully define nor limit the invention. The invention will be more fully understood and better appreciated by reference to the following description and drawings.

DETAILED DESCRIPTION OF THE EMBODIMENTS

Before describing selected embodiments of the present disclosure in detail, it is to be understood that the present invention is not limited to the particular embodiments described herein. The disclosure and description herein is illustrative and explanatory of one or more presently preferred embodiments and variations thereof, and it will be appreciated by those skilled in the art that various changes in the design, organization, order of operation, means of operation, equipment structures and location, methodology, and use of mechanical equivalents may be made without departing from the scope of the current disclosure.

As well, it should be understood that the drawings are intended to illustrate and plainly disclose embodiments of systems and methods to one of skill in the art, but are not intended to be manufacturing level drawings or renditions of final products and may include simplified conceptual views as desired for easier and quicker understanding or explanation. As well, the relative size and arrangement of the components may differ from that shown and still operate within the spirit of the invention.

Moreover, it will be understood that various directions such as "upper", "lower", "bottom", "top", "left", "right", and so forth are made only with respect to explanation in conjunction with the drawings, and that the components may be oriented differently, for instance, during transportation and manufacturing as well as operation. Because many varying and different embodiments may be made within the scope of the concept(s) herein taught, and because many modifications may be made in the embodiments described herein, it is to be understood that the details herein are to be interpreted as illustrative and non-limiting.

Embodiments usable within the scope of the present disclosure include systems for stabilizing a subsea riser against motion (e.g., wave motion and similar forces). Conventional systems (e.g., heave compensation systems) typically use a hydraulic cylinder, secured to a vessel and/or platform, to permit the vessel and/or platform to move relative to a riser or drill string extending below, while exerting a continuous tension on the riser or drill string, within a very narrow tolerance, to prevent motion that could collapse or otherwise damage the riser or drill string, and/or an adjacent component. For example, traditionally, to minimize load and wave motion while working on a rig in deep water, three or more heave compensators may be used, for compensating motions imparted to the derrick or crane, the riser, and the deck.

Embodiments of the present system can include two cylinder apparatus, engaged with a riser, itself, e.g., a first cylinder apparatus engaged with a first portion of a riser and a second cylinder apparatus engaged with a second portion of the riser (such as below or above the first portion, or angularly displaced from the first portion a distance about the circumference of the riser). The first and second cylinder apparatus can be in fluid communication with one another for flowing fluid (e.g., hydraulic oil, nitrogen gas, air, other similar fluids, or combinations thereof) therebetween when wave motion and/or a similar movement or load is applied to the riser. In an embodiment, the two cylinder apparatus can work in tandem (e.g., against one another). For example, a first (e.g., lower) cylinder apparatus can be used to limit movement of the riser and/or compensate for forces from a wellhead and/or blowout preventer at a lower end of the riser, while a second (e.g., upper) cylinder apparatus can be used to limit movement of the riser and/or compensate for forces from a platform and/or vessel (e.g., wave motion on the vessel) at an upper end of the riser. The lower cylinder apparatus can be stationary (e.g., bolted), while the upper cylinder moves up and down concurrent with the motion of a boat or similar vessel and/or platform above the riser. Use of dual cylinder apparatus that work in tandem can provide a riser or similar object with the ability to withstand a movement far in excess of conventional heave compensation systems. For example, an embodiment can enable a riser to safely move a length of 20 feet or more, while conventional systems typically compensate for up to 8 feet of movement.

In use, the cylinder apparatus can be provided with a predetermined pressure and/or quantity of fluid and engineered with specific dimensions and/or tolerances, depending on the expected load, tension, motion, and/or other forces anticipated when the cylinder apparatus are secured to a particular riser, and related factors (e.g., the type of ship, platform, and/or rig used in conjunction with the riser, the weight of the riser, water depth, the time of year or season, water conditions, etc.). For example, depending on the particular depth at which the cylinders will be placed, the dimensions and/or weight of the riser, and the dimensions and/or weight of any platform, vessel, and/or other component engaged with either end of the riser, the cylinders can be engineered, pressurized, loaded, and/or otherwise provided with fluid such that the cylinders can provide a tension, a compressive force, and/or other similar forces, and/or can extend or retract (e.g., using one or more pistons) to provide a desired length thereto to compensate for forces applied to and/or motion of the riser.

In an embodiment, a plurality of fluid channels (e.g., three channels) can extend between two cylinder apparatus to enable rapid flow of fluid responsive to a force and/or load applied to a riser (e.g., through use of one or more relief valves, which can allow the flow of fluid within milliseconds). In further embodiments, the cylinders can be provided with a fluid consisting substantially of nitrogen gas, which can be moved quickly between cylinders responsive to external forces and/or loads, and which can provide reliable pressure and/or other forces to compensate for the external forces and/or loads. Additionally, nitrogen provides a minimal environmental impact, is less likely to leak, and can be provided at pressures more conducive to operator safety than conventional systems. For example, 40-80 gallon bottles of nitrogen can be pre-charged for use with embodiments herein and placed at any desirable location. Direct attachment of the nitrogen bottles to the cylinders is not necessary, and in various embodiments, the nitrogen cylinders can be placed in areas having favorable conditions for preventing formation of ice crystals as the gas moves.

Embodiments of cylinder apparatus usable within the scope of the present disclosure can include a channel (e.g., a longitudinal channel) extending through the body thereof for accommodating a conduit (e.g., coiled tubing, slickline, wireline, e-line, and/or similar objects), enabling various operations to be performed through the cylinder apparatus. For example, through use of the embodied systems, methods, and apparatus described herein, various production, completion, workover, and/or abandonment operations could be performed on a subsea well without requiring a rig or platform, e.g., through use of a vessel that dispenses coiled tubing or a similar conduit therefrom, through a channel in the cylinder apparatus. Conventional heave compensation cylinders lack interior portions capable of accommodating conduits and/or similar objects, the interior of such cylinders being required to accommodate pistons, fluid, and/or various other components thereof. Use of a central (e.g., longitudinal) channel extending through the cylinder apparatus can provide a level of stability exceeding that provided through use of conventional systems. Performing operations through a channel extending through the cylinders provides stability equal to that which would be obtained when working from a rig, rather than working from a boat or similar vessel.

Embodiments described herein can thereby be used to accommodate for any sea or wave conditions, the time of year, and any type of boat and/or platform. When used to enable operations to be performed using a boat rather than a rig, rig costs of more than one million dollars per day can be avoided, while a boat can be operated for less than one fourth of the cost. Additionally, operating from a stable boat rather than a rig provides improved safety to personnel, who can evacuate more rapidly in times of emergency. In various embodiments, disconnection from a riser can be achieved through an emergency quick disconnect feature, usable if inclement weather or a similar emergency requires ejection from the riser. Further, unlike conventional fluids, nitrogen provides a minimal environmental impact, while allowing for faster reaction rate when flowing fluid between cylinders.

While embodiments described herein discuss use of cylinder apparatus to compensate for forces on a riser or similar conduit, it should be understood that the principles described herein are applicable to withstand forces applied to any object. For example, a boat or similar vessel could be provided with a heave compensated floor through use of various embodiments described herein. A boat having a heave compensated floor can be engineered to accommodate for various factors, including the type of boat, the weight of the riser below (if used), the depth of the water, the time of year or season, and the water conditions. In various embodiments, a boat with a heave compensated floor can be used to perform various operations (e.g., coiled tubing operations) without requiring use of a rig or a riser, due to the enhanced stability of the boat itself.

Referring now to FIG. 1, a diagrammatic view of an embodiment of a system usable within the scope of the present disclosure is shown. Specifically, a subsea riser (10) is depicted extending between the floor (12) and surface (14) of a body of water (e.g., an ocean, sea, bay, gulf, etc.). A blowout preventer (16) is shown, which can be representative of one or multiple devices (e.g., a stack of blowout preventers and/or other related devices) positioned at the head (e.g., top) of a well extending below and in fluid communication with the riser (10). A vessel (18), which can include a platform, a jackup, a drill ship, a semisubmersible, or any other type of platform, ship, and/or surface able to be positioned in the body of water is depicted at the surface (14), proximate to the top end of the riser (10). It should be noted that while direct engagement between the top end of the riser (10) and the vessel (18), or another object (e.g., a platform, ship, and/or rig), is omitted for clarity, the vessel (18) or any manner of object can be engaged with the riser (10), as known in the art, for performing operations therewith, including production, completion, workover, and/or abandonment operations. In various embodiments, disconnection from the riser (10) can be achieved through an emergency quick disconnect feature, usable if inclement weather or a similar emergency requires ejection from the riser (10).

A first cylinder apparatus (20) and a second cylinder apparatus (22) are shown engaged with respective portions of the riser (10). Specifically, the first cylinder apparatus (20) is shown engaged to a portion of the riser (10) beneath the second cylinder apparatus (22); however, it should be understood that in various embodiments, any number of cylinder apparatus can be engaged to any portion of the riser (10), in any position relative to one another.

In use, when the riser (10) is subjected to a force and/or movement, one or both cylinder apparatus (20, 22) can compensate for, resist, and/or otherwise accommodate the force and/or movement, e.g., through extension or retraction of pistons, application of force to a portion of the riser (10), or combinations thereof. For example, the first cylinder apparatus (20) can compensate for forces originating from a lower portion of the riser (10) and/or the blowout preventer (16), while the second cylinder apparatus (22) can compensate for forces originating from an upper portion of the riser (10) and/or the vessel (18). Specifically, the cylinder apparatus (20, 22) are shown connected by one or more fluid pathways (30), which can include any manner of conduit and/or pathway extending internally through or exterior of the riser (10). As described above, in various embodiments, the one or more fluid pathways (30) can include three or more fluid pathways which can flow any combination of hydraulic oil, nitrogen gas, oil, or other similar fluids between the cylinders (20, 22). Thus, responsive to a force and/or movement that affects a portion of the riser (10), fluid can be communicated between the cylinder apparatus (20, 22) as needed to compensate for and/or otherwise resist movement of the riser (10). In an embodiment, the two cylinder apparatus (20, 22) can work in tandem (e.g., against one another), to provide the riser (10) with the ability to accommodate a significant force and/or movement. For example, pistons can provide each cylinder apparatus (20, 22) with a ten-foot stroke, or more, enabling extension or retraction of both cylinder apparatus (20, 22) in a manner that enables the riser (10) to withstand a movement that would affect its length by up to twenty feet, or more.

A conduit (24) (e.g., coiled tubing, wireline, slickline, e-line, etc.) is shown extending from the vessel (18), through the riser (10), for performing one or more oilfield operations (e.g., production, completion, workover, and/or abandonment operations) on the depicted well. The conduit (24) is shown passing through a first channel (26) in the first cylinder apparatus (20) and a second channel (28) in the second cylinder apparatus (22), thus enabling various operations to be performed on a well independent of the presence and/or placement of the cylinder apparatus (20, 22), without requiring erection and use of a rig.

As such, the depicted embodiment acts not only as a heave compensation system, but also serves as a barrier to any leaks in a coiled tubing or similar operation performed through the channels (26, 28) in the cylinder apparatus (20, 22). Further, the embodiments described herein enable rigless operations to be performed, where conventional systems would require erection and/or use of a rig, platform, or suitable vessel.

Figure 2A:
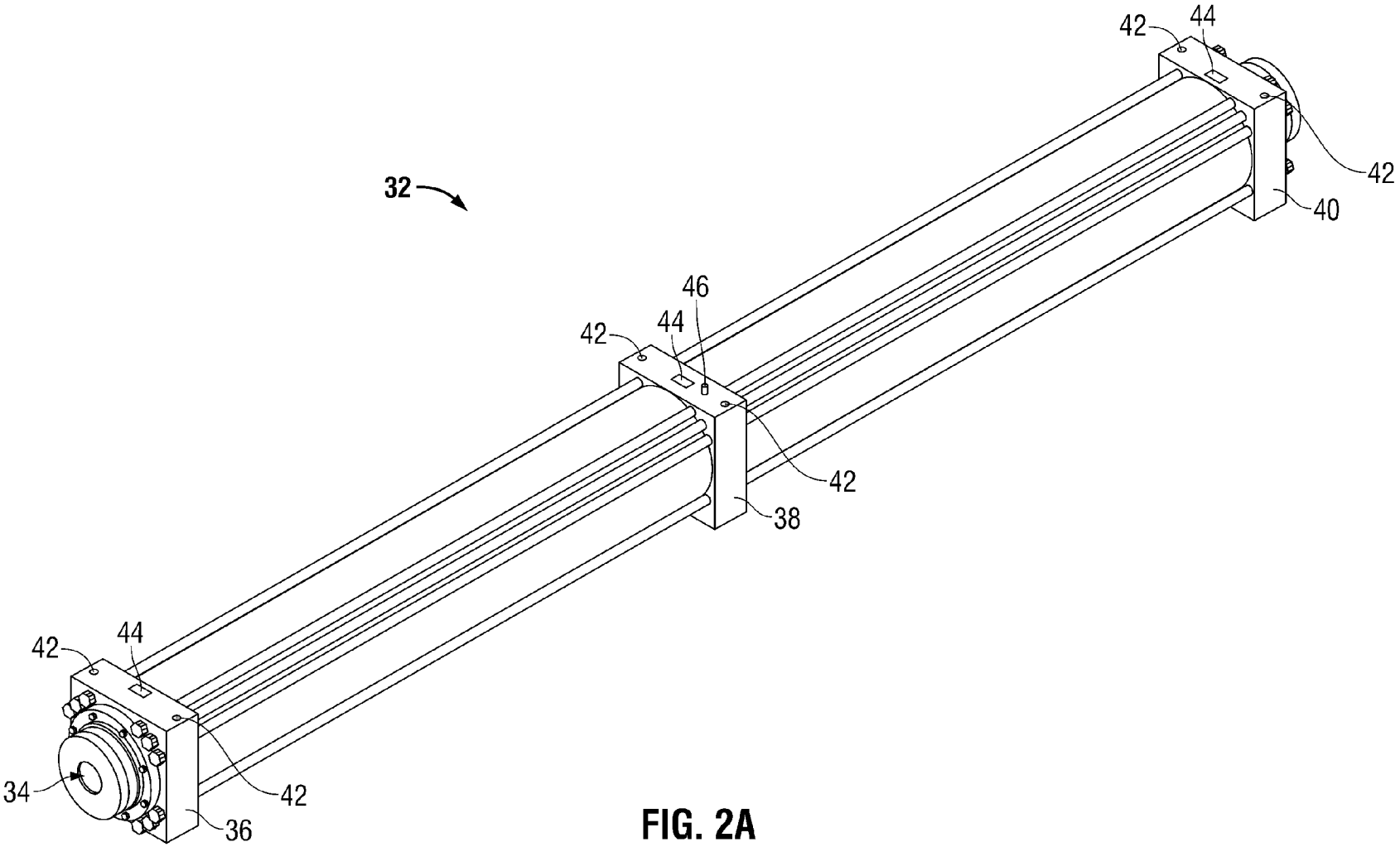
FIG. 2A depicts an isometric view of an embodiment of a cylinder apparatus usable within the scope of the present disclosure.
Figure 2B:
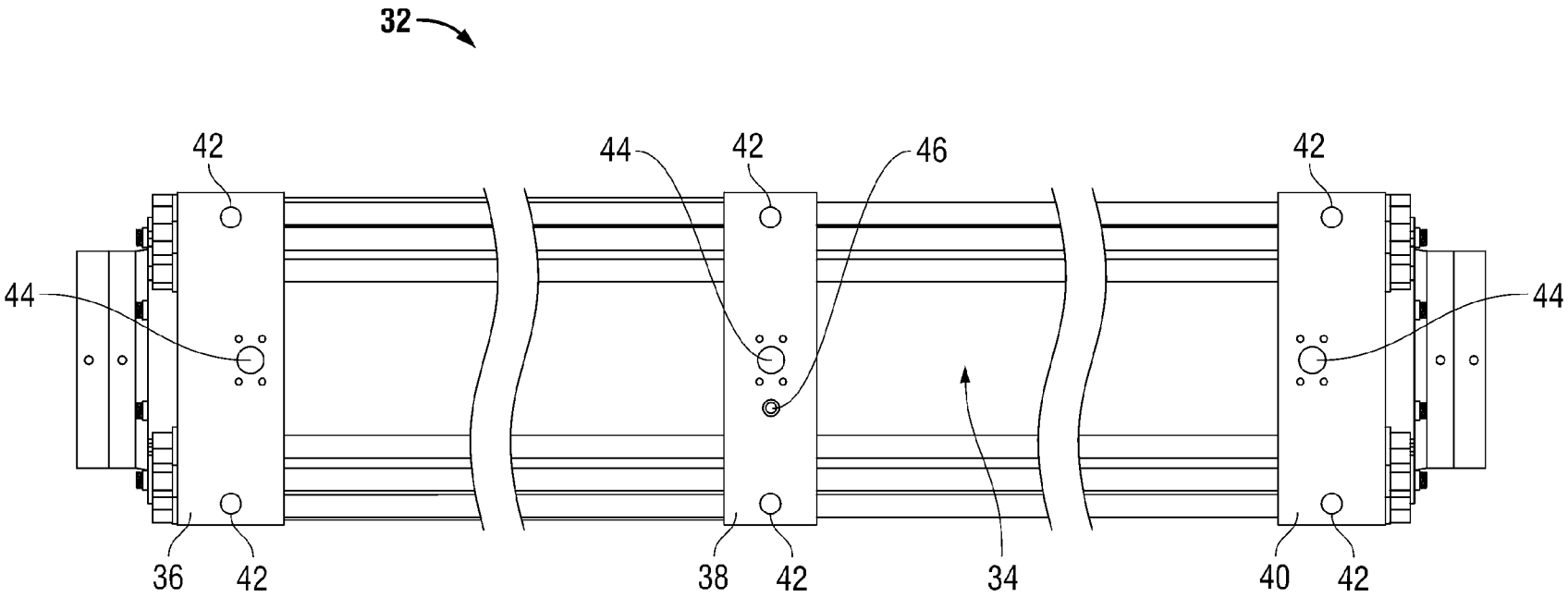
FIG. 2B depicts a diagrammatic elevational side view of the cylinder apparatus of FIG. 2A.
Figure 2C:
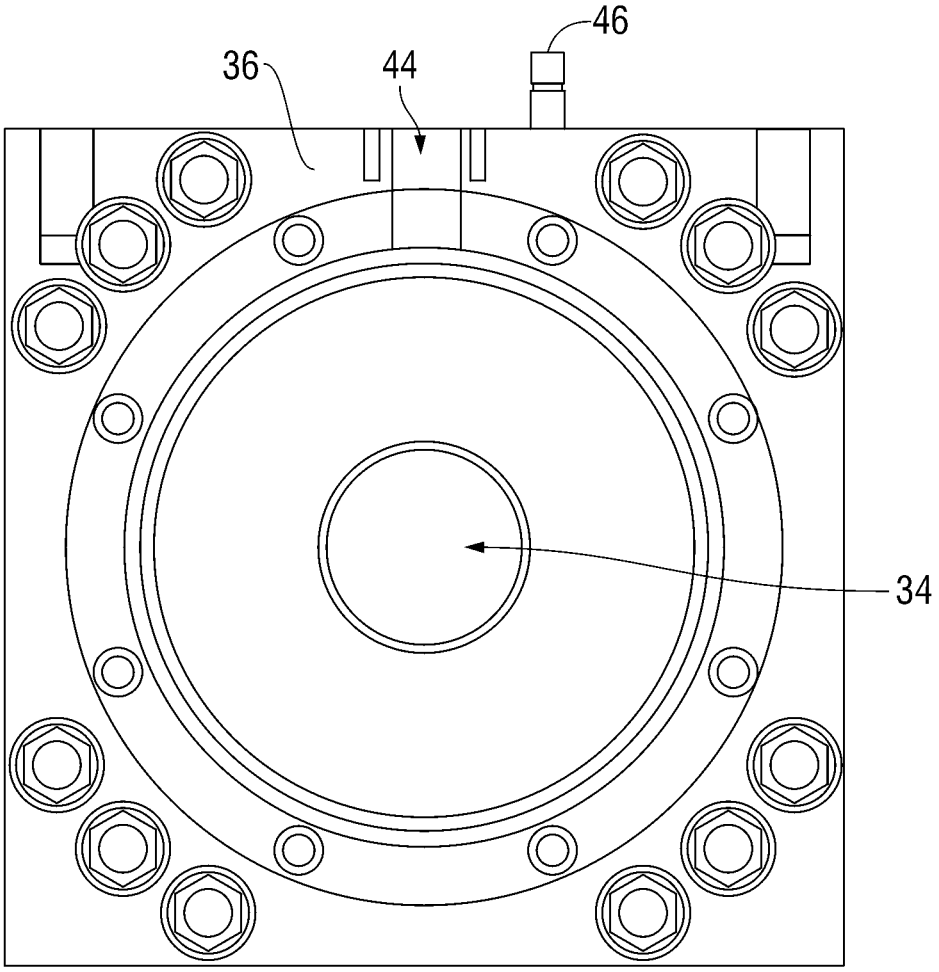
FIG. 2C depicts an end view of the cylinder apparatus of FIGS. 2A and 2B.
Figure 2D:
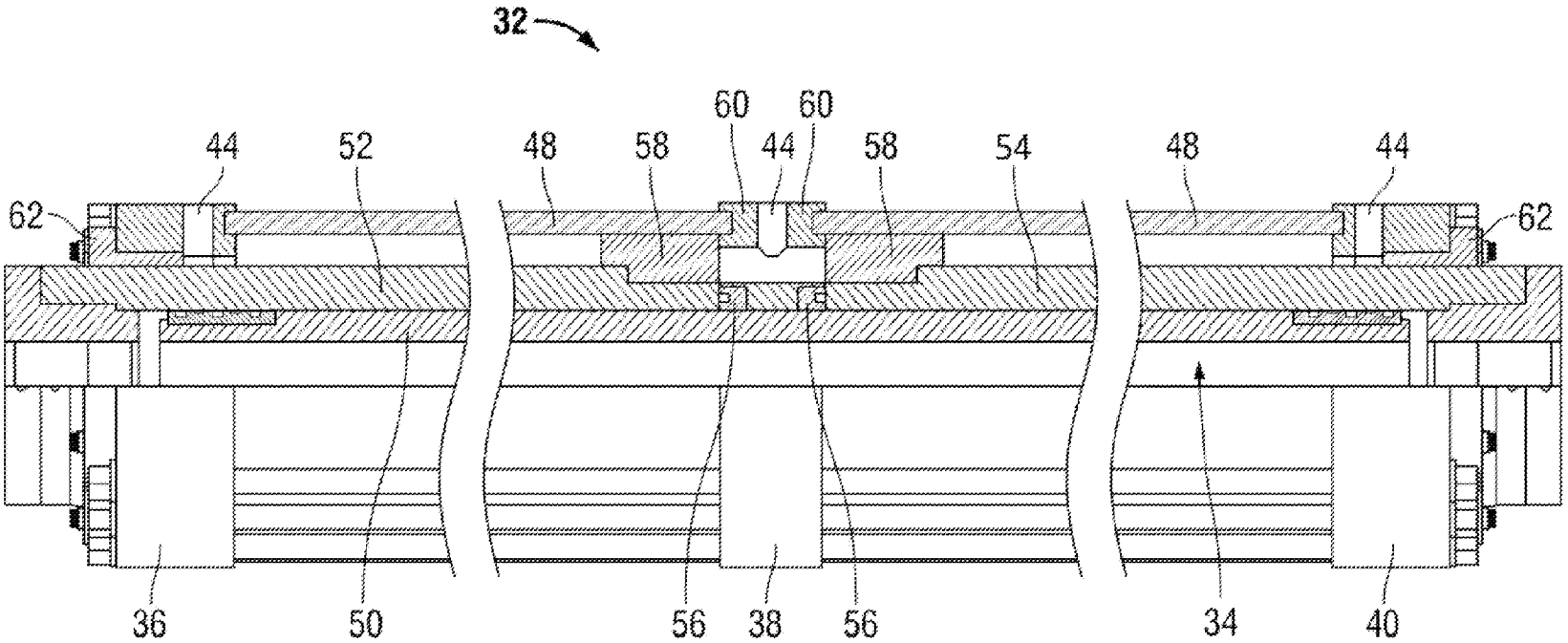
FIG. 2D depicts a partial cross-sectional view of the cylinder apparatus of FIGS. 2A through 2C.

Referring now to FIGS. 2A through 2D, an embodiment of a cylinder apparatus (32) usable within the scope of the present disclosure is shown. Specifically, FIG. 2A depicts an isometric view of the cylinder apparatus (32), FIG. 2B depicts a diagrammatic side view thereof, FIG. 2C depicts an end view, and FIG. 2D depicts a partial side cross-sectional view.

The cylinder apparatus (32) is shown having a generally cylindrical body with a longitudinal channel (34) extending therethrough. The body is shown having three flanges (36, 38, 40) positioned thereon, two of the flanges (36, 40) shown at opposing ends of the apparatus (32), and a third flange (38) shown centrally located. It should be understood, however, that the depicted arrangement of components is exemplary, and that in various embodiments, the body of the cylinder apparatus (32) can include any desired shape, dimensions, and/or materials depending on the characteristics of the riser or other object to which the cylinder apparatus (32) is to be secured, and/or characteristics of the location (e.g., depth, temperature, pressure) at which the apparatus (32) is to be used. Additionally, while FIGS. 2A through 2D show three flanges (36, 38, 40), embodiments of the cylinder apparatus (32) can include any number of flanges having any shape or orientation, and any position along the body of the apparatus (32) relative to one another.

Each flange (36, 38, 40) is shown provided with lifting holes (42), usable to position and/or transport the cylinder (32), and ports (44) for accommodating a fluid conduit and enabling the flow of nitrogen gas and/or similar fluids between multiple cylinder apparatus. The central flange (38) is further shown having a frangible member (46) (e.g., a rupture disc or similar member intended to break when subjected to a preselected pressure), and parbak ring (60) surrounding the port (44) therein. End members (62) are shown at the distal ends of the cylinder (32).

As shown in FIG. 2D, the cylinder apparatus (32) includes an inner wall (50) surrounding the longitudinal conduit (34), and an outer wall (48), having two segments, extending from either side of the central flange (38). Between the outer and inner walls (48, 50), a first movable member (52) is disposed on a first side of the cylinder apparatus (32), and a second movable member (54) is disposed on the second side of the cylinder apparatus. When in the non-extended position, shown in FIG. 2D, the movable members (52, 54) abut sealing surfaces (56), which can include any manner of cup, ring, or similar surface as known in the art.

Communication of fluid into the cylinder apparatus (32) (e.g., into the port (44) in the central flange (38)) will cause the fluid to impart a force to movable ring members (58) disposed on either side of the central flange (38), which in turn imparts a force to the movable members (52, 54), causing outward movement thereof. Alternatively, communication of fluid from the cylinder apparatus (32) can cause retraction of the movable members (52, 54). Expansion of the length of the cylinder apparatus (32) in this manner enables a riser or similar conduit to which the cylinder apparatus (32) is attached to compensate for wave motion and/or similar forces.

Figure 3:
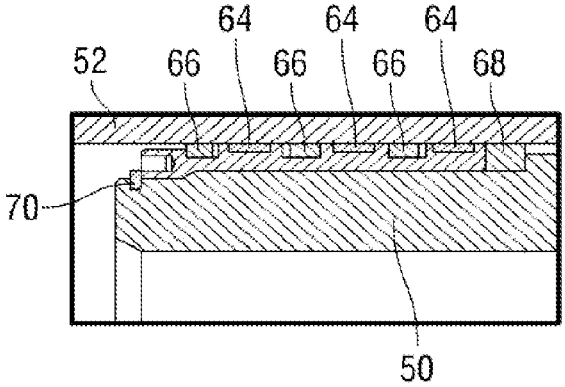
FIG. 3 depicts a partial side cross-sectional view of the cylinder apparatus of FIGS. 2A through 2D, showing a seal member within the cylinder apparatus.

While the specific configuration of internal components of the cylinder apparatus (32) can vary, FIG. 3 depicts a cross-sectional view of an internal region of the cylinder apparatus, showing an arrangement of components between the first movable member (52) and the inner wall (50) of the cylinder. Specifically, a support ring (68) is shown extending therebetween, having three wear rings (64) interspersed with three polymyte cups (66). It should be understood that the depicted configuration of components is merely exemplary, and that any number and arrangement of bearings, wear elements, seals, cups, and other members as known in the art can be used, depending on the intended load and use of the cylinder apparatus. A spiral retaining ring (70) is shown at the outer end of the support ring (68), for retaining the support ring (68) and the wear rings (64) and polymyte cups (66) in place as the movable member (52) extends inward and outward relative thereto.

Figure 4:
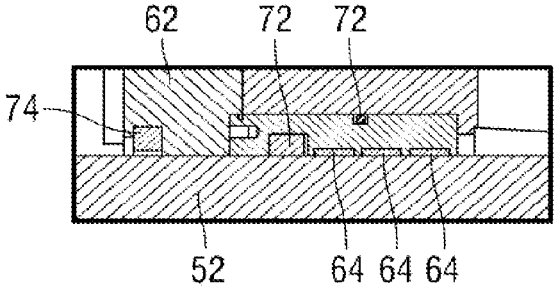
FIG. 4 depicts a partial side cross-sectional view of the cylinder apparatus of FIGS. 2A through 2D, showing a portion of a piston within the cylinder apparatus.

Similarly, FIG. 4 shows a cross-sectional view of an end portion of the cylinder apparatus. Specifically, an end member (62) external to the first movable member (52) is shown, having a wiper (74) thereon. Three wear rings (64) and two sealing members (72) (e.g., O-rings, molythane rod seals, and/or similar sealing elements) are also shown within the end member. Thus, as the first movable member (52) extends inward and outward relative thereto, the wear rings (64) and sealing members (72) remain stationary and provide desirable wear and sealing characteristics, respectively.

Figure 5:
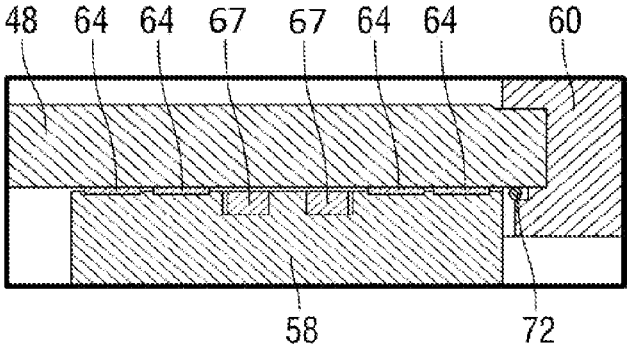
FIG. 5 depicts a partial side cross-sectional view of the cylinder apparatus of FIGS. 2A through 2D, showing an interior end portion of a piston within the cylinder apparatus.

FIG. 5 depicts a cross-sectional view an external portion of the cylinder apparatus, proximate to the central flange (38), showing an arrangement of components between the movable ring member (58) and the outer wall (48) of the cylinder. A parbak ring (60) is shown on either side of the port (44) extending through the central flange (38), which engages the outer wall (48). Between the movable ring member (58) and the outer wall (48), four wear rings (64) are shown, disposed on either side of two piston cups (67). A sealing member (72) (e.g., an O-ring) is shown disposed between the parbak ring (60) and the outer wall (48). Thus, as the movable ring member (58) moves relative to the outer wall (48), the piston cups (67) and wear rings (64) provide desirable sealing and wear characteristics, respectively.

Thus, in use, when the depicted cylinder apparatus (32) encounters a wave motion or similar force, fluid can be flowed into or from the cylinder (32) through the ports (44), causing movement of the movable ring members (58) and movable members (52, 54) relative to the inner and outer walls (50, 48) of the cylinder (32). Any manner of cups, wear rings, sealing members, and similar elements can be provided between movable and stationary surfaces, as desired, such as the configurations shown in FIGS. 3 through 5.

Embodiments described herein thereby provide systems for stabilizing a subsea riser against motion (e.g., wave motion and similar forces), that can be engaged directly to a riser or similar conduit, can flow nitrogen gas or similar fluid between cylinders rapidly and efficiently (e.g., through use of three or more flow conduits), and can provide a conduit with the ability to withstand a movement that exceeds the capabilities of conventional systems. Further, the cylinder apparatus can be provided with channels extending therethrough, for accommodating, coiled tubing, slickline, wireline, e-line, and/or similar objects, enabling various operations to be performed through the cylinders, independent of their placement.

While various embodiments usable within the scope of the present disclosure have been described with emphasis, it should be understood that within the scope of the appended claims, the present invention can be practiced other than as specifically described herein.

What is claimed is:

1. An apparatus for stabilizing a conduit against motion, the apparatus comprising:

a first cylinder assembly comprising a first outer wall and a first movable member slidably positioned within the first outer wall, wherein an end of the first movable member is adapted for connection with a portion of the conduit; and a second cylinder assembly comprising a second outer wall and a second movable member slidably positioned within the second outer wall, wherein an end of the second movable member is adapted for connection with another portion of the conduit;

a central tubular member having an axial bore extending therethrough, wherein the first and second movable members are concentrically positioned about the central tubular member, wherein the first and second movable members are slidable about the central tubular member, wherein the first outer wall is spaced from the central tubular member to form a first annular space therebetween, wherein the second outer wall is spaced from the central tubular member to form a second annular space therebetween, wherein the first annular space and the second annular space are in fluid communication, wherein the apparatus comprises a first fluid port for communicating a fluid into and out of the first annular space, the second annular space, or combinations thereof.

2. The apparatus of claim 1, wherein the axial bore of the central tubular member is isolated from the first annular space and the second annular space.

3. The apparatus of claim 1, further comprising:

a second fluid port for communicating the fluid into and out of the first annular space; and a third fluid port for communicating the fluid into and out of the second annular space.

4. The apparatus of claim 1, wherein the first movable member comprises a first piston, wherein the second movable member comprises a second piston.

5. The apparatus of claim 4, wherein the first fluid port communicates fluid into contact with the first piston and the second piston.

6. The apparatus of claim 4, wherein the first piston is movable through the first annular space, and wherein the second piston is movable through the second annular space.

7. The apparatus of claim 1, wherein the axial bore is adapted to receive therethrough a slickline, a wireline, a tubing, a tool, or combinations thereof.

8. The apparatus of claim 1, wherein the conduit comprises a riser.

9. An apparatus for stabilizing a conduit against motion, the apparatus comprising: an outer wall portion; an inner tubular member having a longitudinal channel extending therethrough, wherein the outer wall portion at least partially surrounds the inner tubular member; a first tubular member at least partially located between the outer wall portion and the inner tubular member, wherein the first tubular member is movable about the inner tubular member, wherein the first tubular member is adapted for securing to the conduit; and a second tubular member at least partially located between the outer wall portion and the inner tubular member, wherein the second tubular member is movable about the inner tubular member, wherein the first and the second tubular members are movable relative to each other, wherein the first tubular member is adapted for securing to the conduit; and, wherein the conduit comprises a riser.

10. The apparatus of claim 9, further comprising a first fluid port for communicating a fluid into the apparatus to extend out the first tubular member, the second tubular member, or combinations thereof from the outer wall portion.

11. The apparatus of claim 10, further comprising:

a second fluid port for communicating the fluid into the apparatus to retract the first tubular member into the outer wall portion; and a third fluid port for communicating the fluid into the apparatus to retract the second tubular member into the outer wall portion.

12. The apparatus of claim 9, wherein the longitudinal channel of the inner tubular accommodates a tubular, a slickline, a wireline, a tool, or combination thereof usable to perform an oilfield operation.

13. The apparatus of claim 9, wherein an internal end of the first tubular member comprises a sealing ring fixedly attached to the first tubular member, wherein the sealing ring of the first tubular member forms a fluid seal against the outer wall, wherein an internal end of the second tubular member comprises a sealing ring fixedly attached to the second tubular member, wherein the sealing ring of the second tubular member forms a fluid seal against the outer wall.

14. The apparatus of claim 9, further comprising a first fluid port for communicating a fluid into or out of the apparatus as the first tubular member, the second tubular member, or combinations thereof extend out from or retract into the outer wall portion.

15. The apparatus of claim 14, further comprising:

a second fluid port for communicating the fluid into or out of the apparatus as the first tubular member retracts into or extends out from the outer wall portion; and a third fluid port for communicating the fluid into or out of the apparatus as the second tubular member retracts into or extends out from the outer wall portion.

16. The apparatus of claim 14, wherein the first fluid port communicates fluid into a central space located between the inner tubular member and the outer wall portion.

17. The apparatus of claim 14, wherein the longitudinal channel of the inner tubular member is fluidly isolated from the fluid communicated into and out of the apparatus through the first port.

18. An apparatus for stabilizing a conduit against motion, the apparatus comprising:

a first cylinder assembly comprising a first outer wall and a first piston slidably positioned within the first outer wall, wherein an end of the first piston is adapted for connection with a portion of the conduit; and a second cylinder assembly comprising a second outer wall and a second piston slidably positioned within the second outer wall, wherein an end of the second piston is adapted for connection with another portion of the conduit;

a central tubular member having an axial bore extending therethrough, wherein the first and second pistons are concentrically positioned about the central tubular member, wherein the first and second pistons are slidable about the central tubular member, wherein the first outer wall is spaced from the central tubular member to form a first annular space therebetween, wherein the second outer wall is spaced from the central tubular member to form a second annular space therebetween, wherein the apparatus comprises a first fluid port for communicating a fluid into and out of the first annular space, the second annular space, or combinations thereof.

19. The apparatus of claim 18, wherein the axial bore of the central tubular member is fluidly isolated from the annular space between the first outer wall and the central tubular member.

* * * * *